US005255659A

United States Patent [19]

Choma

[11] Patent Number: 5,255,659

[45] Date of Patent: Oct. 26, 1993

[54] PRESSURE BALANCED EXHAUST GAS RECIRCULATION VALVE

[75] Inventor: Michael A. Choma, Dearborn Heights, Mich.

[73] Assignee: Ford Motor Company, Dearborn, Mich.

[21] Appl. No.: 952,084

[22] Filed: Sep. 28, 1992

[51] Int. Cl.[5] ..... F02M 25/07

[52] U.S. Cl. ..... 123/568

[58] Field of Search ..... 123/568, 569, 570, 571; 251/282

[56] References Cited

U.S. PATENT DOCUMENTS

| | | | |
|---|---|---|---|
| 2,566,051 | 8/1951 | Avery . | |
| 2,621,676 | 12/1952 | Loft . | |
| 3,358,964 | 12/1967 | Cohen et al. | 251/324 |
| 3,396,751 | 8/1968 | Bender | 137/625.65 |
| 3,561,482 | 2/1971 | Taplin | 137/625.4 |
| 3,814,070 | 6/1974 | Wertheimer | 123/568 |
| 3,908,618 | 9/1975 | Tange et al. | 123/568 |
| 3,927,650 | 12/1975 | Smith et al. | 123/568 |
| 3,982,515 | 9/1976 | Bradshaw | 123/568 |
| 4,057,085 | 11/1977 | Shibabi | 141/59 |
| 4,068,637 | 1/1978 | Takamiya | 123/568 |
| 4,397,289 | 8/1983 | Haka et al. | 123/571 |
| 4,398,524 | 8/1983 | Rachedi | 123/568 |
| 4,475,525 | 10/1984 | Fukae | 123/568 |
| 4,662,604 | 5/1987 | Cook | 123/568 X |
| 4,683,863 | 8/1987 | Sugiura | 123/568 |
| 4,702,209 | 10/1987 | Sausner et al. | 123/339 |
| 4,991,547 | 2/1991 | Davis et al. | 123/52 MF |
| 5,056,309 | 10/1991 | Linder et al. | 60/278 |
| 5,067,470 | 11/1991 | Panten et al. | 123/568 |

*Primary Examiner*—Willis R. Wolfe

*Attorney, Agent, or Firm*—Jerome R. Drouillard; Roger L. May

[57] ABSTRACT

An exhaust gas recirculation (EGR) valve has a gas force balancing diaphragm which equalizes the gas pressure forces acting upon the valve's metering element so as to minimize the force required to position the metering element, which is operated by an external actuator.

2 Claims, 1 Drawing Sheet

PRESSURE BALANCED EXHAUST GAS RECIRCULATION VALVE

FIELD OF THE INVENTION

This invention relates to an exhaust gas recirculation ("EGR") valve for an internal combustion engine.

BACKGROUND OF THE INVENTION

Recirculation of exhaust gases has been developed as a method for inhibiting formation of oxides of nitrogen during the combustion process of an internal combustion engine. In general, it is desirable to recirculate exhaust gases at a rate proportional to the rate of engine air flow. To this end, EGR control assemblies have traditionally included an EGR valve having a pintle which is positioned by a vacuum powered diaphragm to provide the desired EGR flow. Such EGR valves are of limited usefulness with unthrottled engines such as Diesel or certain types of direct injected spark ignition engines because such engines typically operate with lower manifold vacuum levels.

U.S. Pat. No. 4,398,524 discloses an EGR assembly including a valve operated by a diaphragm powered by an air pump. U.S. Pat. No. 4,397,289 discloses a conventional unbalanced EGR valve. The EGR valves of the '524 and '289 patents require high forces for valve operation and are limited in flow capacity.

It is an advantage of the present invention that an EGR valve according to this invention does not require high operating forces regardless of the magnitude of the pressure difference across the valve.

It is another advantage of the present invention that an EGR valve according to this invention allows for a large flow area at wide open throttle operation, when the pressure difference across the valve's metering element is small.

It is yet another advantage of the present invention that an EGR valve according to this invention allows very little leakage when the valve is closed.

SUMMARY OF THE INVENTION

An EGR system for an internal combustion engine having an exhaust manifold and an intake manifold comprises a valve body having a first passage connected with the intake manifold and a second passage connected with the exhaust manifold. A linearly actuatable metering element is positioned between the first and second passages such that the flow of exhaust gas through the valve is determined by the position of the metering element. The valve includes means for equalizing gas pressure forces acting on the metering element, with such means comprising a two-sided diaphragm connected with the metering element along its line of action, with the diaphragm having one side operatively connected with the first passage and the other side operatively connected with the second passage. The size of the diaphragm is selected such that the gas forces acting upon the metering element are balanced by the gas forces acting upon the diaphragm. A valve according to the present invention also comprises an actuator for applying a control force to the metering element.

BRIEF DESCRIPTION OF THE DRAWINGS

The FIGURE contains a schematic representation of an EGR valve and system according to the present invention.

DETAILED DESCRIPTION OF THE PREFERRED EMBODIMENT

Figure 1:
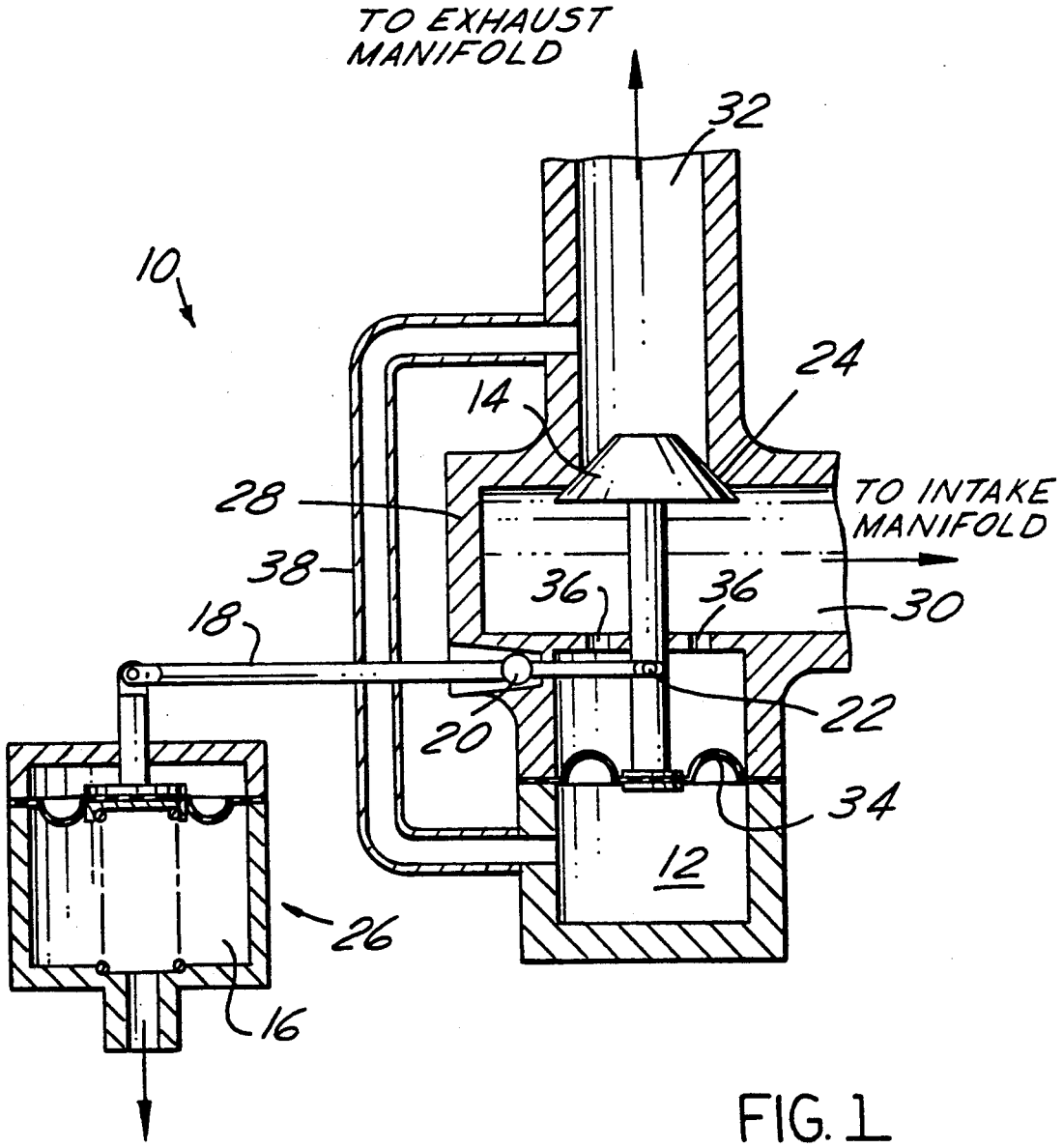

As shown in the FIGURE, an EGR valve, 10, according to the present invention comprises a linearly actuatable metering element, in this case a poppet valve, 14, which is contained in a valve body, 28. Poppet valve 14 closes against seat 24. The EGR system includes a first passage 30, extending from valve 10 to the intake manifold (not shown), and a second passage, 32, extending from the exhaust manifold (not shown) to EGR valve 10.

A balance chamber, 12, receives stem 15 of poppet 14 and houses two-sided diaphragm 34, which is attached to stem 15. The pressure existing within the intake manifold is communicated with the upper side of diaphragm 34 via ports 36. The pressure existing within the exhaust manifold is communicated with the lower side of diaphragm 34 via jumper line 38. The size of diaphragm 34 is selected so that the force of exhaust gas acting upon the upper face of poppet 14 and the force of the intake manifold vacuum acting upon the lower face of poppet 14 are balanced by the gas forces acting upon diaphragm 34. In this manner, the actuation force required to place poppet 14 in any desired location will be minimized.

An actuator, 26, which is illustrated as being of the diaphragm type, positions poppet 14 via connecting link 18, pivot 20, and pivot 22. Those skilled in the art will appreciate in view of this disclosure that actuator 26 could comprise not only the illustrated diaphragm type of actuator, but also other types of actuators such as solenoids, gear motors, and other actuators.

In operation, exhaust gas enters passage 32 from the exhaust manifold and flows over seat 24 into passage 30. The position of poppet 14, which is determined by actuator 26, governs the flow through the valve. The position of poppet 14 is essentially independent of the pressures within passages 30 and 32 because these pressures are, as described above, applied to diaphragm 34 so as to equalize their application to poppet 14.

I claim:

1. An exhaust gas recirculation (EGR) system for an internal combustion engine having an exhaust manifold and an intake manifold, said valve comprising:

a valve body having a first passage connected with said intake manifold and a second passage connected with said exhaust manifold and having a linearly actuatable metering element positioned between said first and second passages such that the flow of exhaust gas through the valve is determined by the position of the metering element;

means for equalizing gas pressure forces acting on the metering element, with such means comprising a single two-sided diaphragm connected with the linearly actuatable valve along the line of action of the valve, with said diaphragm having one side operatively connected with said first passage and the other side operatively connected with said second passage, and with said diaphragm having a size selected such that the gas forces acting upon the metering element are balanced solely by the intake and exhaust gas forces acting upon the diaphragm; and means for applying a control force to the linearly actuatable valve.

2. An exhaust gas recirculation (EGR) system according to claim 1, wherein said means for applying a control force to the linearly actuatable valve comprises an actuator mounted outside the valve body and having a pivoted link extending through the valve body, with one end of the link pivotably attached to said metering element and the other end pivotably attached to said actuator.

* * * * *